US010649353B2

(12) United States Patent
Wu

(10) Patent No.: US 10,649,353 B2
(45) Date of Patent: May 12, 2020

(54) TETHERED METAL DIOXIDE FOR IMAGING MEMBERS

(71) Applicant: Xerox Corporation, Norwalk, CT (US)

(72) Inventor: Jin Wu, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/150,418

(22) Filed: Oct. 3, 2018

(65) Prior Publication Data

US 2020/0110344 A1 Apr. 9, 2020

(51) Int. Cl.

| | |
|---|---|
| ***G03G 5/00*** | (2006.01) |
| ***G03G 5/082*** | (2006.01) |
| ***G03G 5/14*** | (2006.01) |
| ***G03G 15/00*** | (2006.01) |

(52) U.S. Cl.

CPC ..... *G03G 5/082* (2013.01); *G03G 5/144* (2013.01); *G03G 15/751* (2013.01); *G03G 2215/00957* (2013.01)

(58) Field of Classification Search

CPC ..... G03G 5/144
USPC ..... 430/60
See application file for complete search history.

(56) References Cited

U.S. PATENT DOCUMENTS

2009/0297967 A1* 12/2009 Wu ..... G03G 5/0614 430/58.8

* cited by examiner

*Primary Examiner* — Mark A Chapman
(74) *Attorney, Agent, or Firm* — Hoffman Warnick LLC

(57) ABSTRACT

Described herein is a photoreceptor and a method of making metal oxide particles having hygroscopic polymers attached to a surface of the metal oxide particles. The photoreceptor includes a conductive substrate and an undercoat layer disposed on the conductive substrate. The undercoat layer includes metal oxide particles having hygroscopic polymers attached to a surface of the metal oxide particles. The undercoat layer includes a binder resin. A photosensitive layer is disposed on the undercoat layer.

19 Claims, 2 Drawing Sheets

TETHERED METAL DIOXIDE FOR IMAGING MEMBERS

BACKGROUND

Field of Use

This disclosure is generally directed to layered imaging members, photoreceptors and photoconductors.

Background

Metal oxide-based undercoat layers for imaging members provide the functions of blocking holes from metal substrate injection and conducting electrons from the charge generation layer to metal substrate. The unidirectional conduction of electrons can be achieved by n-type semiconductors particles such as certain metal oxides.

It would be desirable to increase the conductivity of metal oxide particles.

SUMMARY

Disclosed herein is a photoreceptor that includes a conductive substrate and an undercoat layer disposed on the conductive substrate. The undercoat layer includes metal oxide particles having hygroscopic polymers attached to a surface of the metal oxide particles. The undercoat layer includes a binder resin. A photosensitive layer is disposed on the undercoat layer.

Additionally, disclosed herein is a photoreceptor including a conductive substrate and an undercoat layer disposed on the conductive substrate. The undercoat layer includes metal oxide particles having hygroscopic polymers attached to a surface of the metal oxide particles and a binder resin. The photoreceptor includes a charge generation layer disposed on the undercoat layer. The photoreceptor includes a charge transport layer disposed on the undercoat layer.

Further, there is disclosed herein a method of modifying a surface of a metal oxide particle. The method includes mixing a metal oxide particle with a phosphonatomethylaryl moiety where the phosphonatomethylaryl moiety attaches to the surface of the metal oxide particle. The method includes polymerizing a hydrophilic monomer with the phosphonatomethylaryl moiety to form a hygroscopic polymer on the surface of the metal oxide particle.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
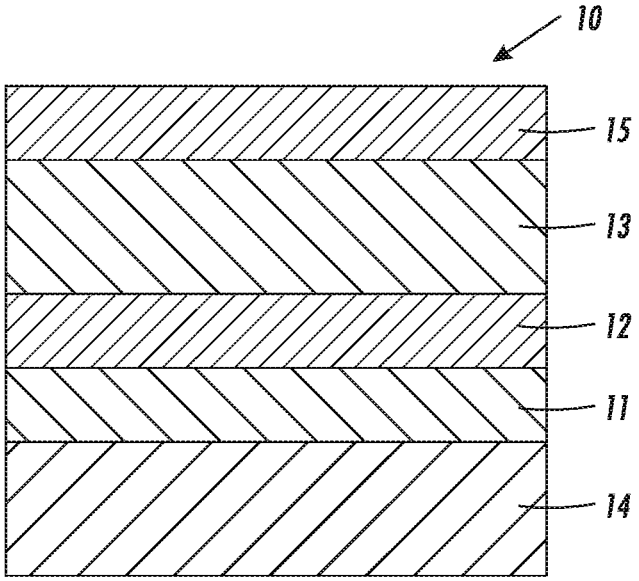
FIG. 1 is a schematic cross-sectional view of an embodiment of a photoreceptor layered structure according to the disclosure provided herein.

It should be noted that some details of the FIGS. have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

As used herein, the term, "electrostatographic," or grammatic versions thereof, is used interchangeably with the terms, "electrophotographic" and "xerographic." The terms, "charge blocking layer" and "blocking layer," are used interchangeably with the terms, "undercoat layer" or "undercoat," or grammatical versions thereof. "Photoreceptor," is used interchangeably with, "photoconductor," "imaging member" or "imaging component," or grammatical versions thereof.

In electrostatographic reproducing or imaging devices, including, for example, a digital copier, an image-on-image copier, a laser printer, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, such as, a photoreceptor, which may be present as an integral component of an imaging device or as a replaceable component or module of an imaging device, and that latent image is rendered visible using electroscopic, finely divided, colored or pigmented particles, or toner. The imaging device component or photoreceptor can be used in electrostatographic (xerographic) imaging processes and devices, for example, as a flexible belt or in a rigid drum configuration. Other components may include a flexible intermediate image transfer belt, which can be seamless or seamed.

In electrostatographic image formation, a photoreceptor is charged and then exposed to light for formation of an electrostatic latent image. The exposure of the photoreceptor to light causes the attenuation of the surface potential thereof; in this process, electric charges move at the interface between the photosensitive layer (for example, a charge-generating layer in a functionally-separated photosensitive layer) and the undercoat layer. In the undercoat layer electric charges are transferred.

Figure 2:
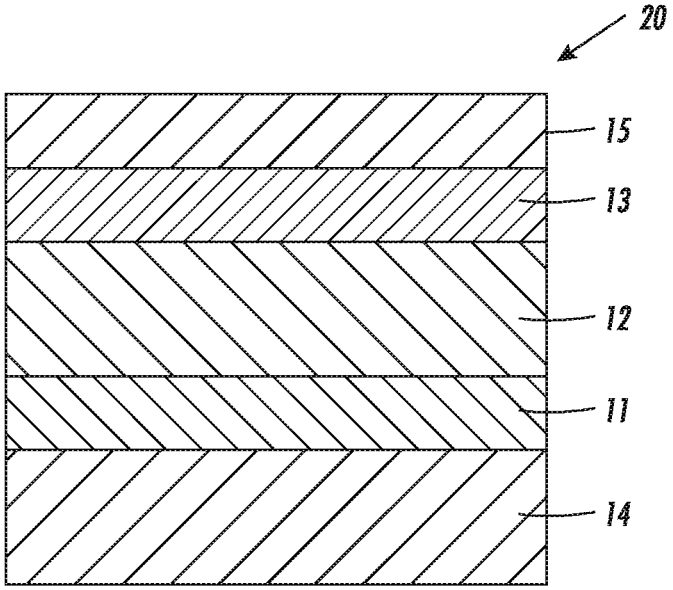
FIG. 2 is a schematic cross-sectional view of an alternate embodiment of a photoreceptor layered structure according to the disclosure provided herein.
Figure 3:
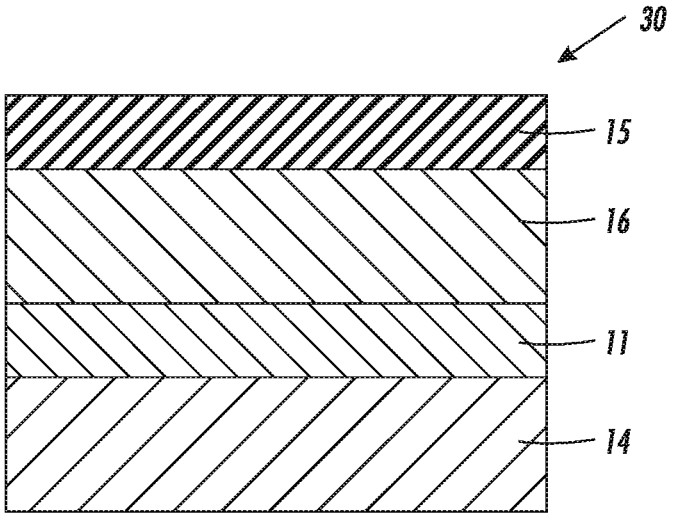
FIG. 3 is a schematic cross-sectional view of an alternate embodiment of a photoreceptor layered structure according to the disclosure provided herein.

FIG. 1 is a schematic cross-sectional view illustrating an embodiment of a photoreceptor. FIGS. 2 and 3 are schematic cross-sectional views illustrating alternative embodiments of photoreceptors.

A photoreceptor 10 illustrated in FIG. 1 is functionally-separated photoreceptor (layered photoreceptor) and includes a conductive substrate 14; an undercoat layer 11 formed thereon; a charge generation layer 12; charge transport layer 13; and an overcoat layer 15. The layers disclosed are disposed in sequence so as to overlie the conductive substrate 14 and the undercoat layer 11. In the photoreceptor 10 of FIG. 1, the charge generation layer 12 and the charge transport layer 13 constitute a photosensitive layer.

A photoreceptor 20 illustrated in FIG. 2 is a functionally-separated photoreceptor in which the charge generation layer 12 and the charge transport layer 13 are functionally separated as in the photoreceptor 10 illustrated in FIG. 1. The photoreceptor 20 illustrated in FIG. 2 includes the conductive substrate 14 and the undercoat layer 11 formed thereon. The charge transport layer 13, charge generation layer 12, and overcoat layer 15 are disposed in sequence so as to overlie the conductive substrate 14 and the undercoat layer 11. In the photoreceptor 20, the charge transport layer 13 and the charge generation layer 12 constitute a photosensitive layer. The charge transport layer 13 and the charge generation layer 12 in FIG. 2 are reversed from the sequence shown in FIG. 1.

A photoreceptor 30 is illustrated in FIG. 3. The photoreceptor 30 in FIG. 3 includes a charge generating material and a charge transporting material in a single layer (photosensitive layer 16). The photoreceptor 30 illustrated in FIG. 3 includes the conductive substrate 14, the undercoat layer 11 formed thereon, and the single photosensitive layer 16 disposed so as to overlie the conductive substrate 14 and the undercoat layer 11. An overcoat layer 15 overlies the photosensitive layer 16.

Each layer of the photoreceptor 10 illustrated in FIG. 1, the photoreceptor 20 in FIG. 2 and the photoreceptor 30 in FIG. 3 are described below.

Conductive Substrate (14)

Examples of the conductive substrate 14 include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

The conductive substrate 14 may be flexible or rigid and may have any of a number of different configurations, such as, for example, a sheet, a scroll, an endless flexible belt, a web, a cylinder, and the like.

The thickness of the conductive substrate depends on numerous factors, including the required mechanical performance and economic considerations. The thickness of the conductive substrate 14 is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The conductive substrate 14 for a flexible belt may be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the conductive substrate 14 to which other layers may be applied may be cleaned to promote greater adhesion of such layers. Cleaning may be effected, for example, by exposing the surface of the substrate layer to plasma discharge, ion bombardment, and the like. Other methods, such as solvent cleaning, may also be used.

Charge Generation Layer (12)

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, chlorogallium phthalocyanine, titanyl phthalocyanine and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. In embodiments, alloys of selenium may be used and include for instance selenium-arsenic, selenium-tellurium-arsenic, and selenium-tellurium.

Any suitable inactive resin binder material may be employed in the charge generating layer 14. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent may be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the weight of the composition including a solvent. The amount of photoconductive particles (i.e., the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Because the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. The average photoconductive particle size may be less than about 0.4 micrometer. In embodiments, the photoconductive particle size is also less than the thickness of the dried photoconductive coating in which it is dispersed.

In a charge generation layer 12, the weight ratio of the charge generating material ("CGM") to the binder ranges from 30 (CGM):70 (binder) to 70 (CGM):30 (binder).

For multilayered photoreceptors comprising a charge generation layer 12 and a charge transport layer 13, satisfactory results may be achieved with a dried photoconductive layer coating thickness of between about 0.1 micrometer and about 10 micrometers. In embodiments, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges may be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer, a non-polymeric material, or a structured organic film (SOF), which may be a composite and/or capped SOF, capable of supporting the injection of photoexcited holes or transporting electrons from the photoconductive material and allowing the transport of these holes or electrons through the organic layer to selectively dissipate a surface charge.

Charge Transport Layer (13)

Additional charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methylpyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, see U.S. Pat. No. 4,921,769 the disclosure of which is incorporated herein by reference in its entirety. Other hole transporting materials include arylamines described in U.S. Pat. No. 4,265,990 the disclosure of which is incorporated herein by reference in its entirety, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules may be selected, reference for example U.S. Pat. Nos. 4,921,773 and 4,464,450 the disclosures of which are incorporated herein by reference in their entireties.

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. The solids content is between about 2 percent by weight and 30 percent by weight based on the total weight of the dispersion. The expression "solids" refers, for example, to the charge transport particles and binder components of the charge transport coating dispersion. These solids concentrations are useful in dip coating, roll, spray coating, and the like. Generally, a more concentrated coating dispersion may be used for roll coating. Drying of the deposited coating may be effected by any suitable conventional technique such as oven drying, infra-red radiation drying, air drying and the like. Generally, the thickness of the transport layer is between about 5 micrometers to about 100 micrometers, but thicknesses outside these ranges can also be used. In general, the ratio of the thickness of the charge transport layer to the charge generating layer is maintained, for example, from about 2:1 to 200:1 and in some instances as great as about 400:1.

Single Photosensitive Layer (16)

A photosensitive layer 16 (charge-generating/charge-transporting layer, embodied in FIG. 3) is, for example, a layer containing a charge-generating material, a charge-transporting material, and optionally a binder resin and another known additive. These materials are the same as those materials used for forming the charge-generating layer and the charge-transporting layer.

The amount of the charge-generating material contained in the single photosensitive layer is suitably from 10 weight % to 85 weight %, and preferably from 20 weight % to 50 weight % relative to the total solid content. The amount of the charge-transporting material contained in the single photosensitive layer is suitably from 5 weight % to 50 weight % relative to the total solid content.

The photosensitive layer 16 is formed by the same technique as those for forming the charge generation layer 12 and the charge transport layer 13.

The thickness of the single photosensitive layer 16 is, for instance, suitably from 5 microns to 50 microns, or in embodiments from 10 microns to 40 microns.

Overcoat Layer (15)

An overcoat layer 15 is optionally formed on the photosensitive layer. The overcoat layer 15 is formed, for instance, in order to prevent the photosensitive layer from being chemically changed in the charging and to improve the mechanical strength of the photosensitive layer. The overcoat layer is properly a layer of a cured film (crosslinked film). The thickness of the protective layer is, for instance, adjusted to be preferably from 1 micron to 20 microns, and more preferably from 2 microns to 10 microns.

In embodiments, the overcoat layer 15 may have a thickness ranging from about 1 micron to about 25 microns or from about 1 micron to about 10 microns, or in a specific embodiment, about 3 microns to about 10 microns. The overcoat layer may include a charge transport component and an optional organic polymer or inorganic polymer. The overcoat layer may include thermoplastic organic polymers or cross-linked polymers such as thermosetting resins, UV or e-beam cured resins, and the likes.

The overcoat layer 15 may further include a particulate additive such as metal oxides including aluminum oxide and silica, or low surface energy polytetrafluoroethylene (PTFE), and combinations thereof. Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with the polymer resin to form a cured composition.

In embodiments, the overcoat layer may comprise structured organic films (SOFs) that are electrically insulating or slightly semi-conductive. Such an overcoat includes a structured organic film forming reaction mixture containing a plurality of molecular building blocks that optionally contain charge transport segments as described in U.S. Pat. No. 8,372,566 incorporated by reference in its entirety.

Additives may be present in the overcoat layer 15 in the range of about 0.5 to about 40 weight percent of the overcoat layer 15. In embodiments, additives include organic and inorganic particles, which can further improve the wear resistance and/or provide charge relaxation property. In embodiments, organic particles include Teflon powder, carbon black, and graphite particles. In embodiments, inorganic particles include insulating and semiconducting metal oxide particles such as silica, zinc oxide, tin oxide and the like. Another semiconducting additive is the oxidized oligomer salts as described in U.S. Pat. No. 5,853,906 the disclosure of which is incorporated herein by reference in its entirety. In embodiments, oligomer salts are oxidized N,N,N',N'-tetra-p-tolyl-4,4'-biphenyldiamine salt.

Undercoat Layer (11)

The undercoat layer 11 prevents hole injection from the conductive substrate 14 and conducts electrons from the charge generation layer to the conductive substrate 14. The undercoat layer 11 may be positioned over the electrically conductive substrate 14. The term "over," as used herein in connection with many different types of layers, should be understood as not being limited to instances wherein the layers are contiguous. Rather, the term "over" refers, for example, to the relative placement of the layers and encompasses the inclusion of unspecified intermediate layers.

It is known that the conductivity of metal oxides is humidity dependent with higher conductivity in more humid environment due to more moisture adsorption onto its surface. However, the ability of adsorbing moisture from less humid environment is very limited. By chemical attachment of hygroscopic polymeric moiety onto a metal oxide surface, significantly enhanced conductivity in less humid environment can be achieved. The attached hygroscopic polymeric chains adsorb more moisture onto the metal oxide surface from the environment than the otherwise intact metal oxide surface. Furthermore, the attached polymeric chains significantly enhance metal oxide dispersibility in polymeric films.

The undercoat layer 11 disclosed herein includes metal oxide particles having a hygroscopic polymer attached to the surface and a binder resin. The binder resin can be a polyamide resin, a nylon resin, for example, copolymer nylon polymerized with 6-nylon, 6,6-nylon, 610-nylon, 11-nylon, 12-nylon and the like; and nylon which is chemically denatured such as N-alkoxy methyl denatured nylon and N-alkoxy ethyl denatured nylon. Another type of binder resin that may be used is a phenolic resin or polyvinyl butyral resin.

The metal oxide particles having hygroscopic polymers attached to a surface of the metal oxide particles are from about 10 weight percent to about 80 weight percent relative to the weight of binder resin in the undercoat layer 11.

The undercoat layer 11 may have a thickness ranging, for example, from about 0.01 to about 40 micrometers, such as from about 1 to about 20 micrometers.

The undercoat layer 11 is formed by dispersing the binder resin, the metal oxide particles having a hygroscopic polymer attached to the outer surface in a solvent to form a coating solution for the undercoat layer 11. The conductive substrate 14 is coated with the coating solution and dried.

The solvent may be a mixture of an azeotropic mixture of $C_{1-4}$ lower alcohol and another organic solvent selected from the group consisting of dichloromethane, chloroform, 1,2-dichloroethane, 1,2-dichloropropane, toluene, xylene, methyl ethyl ketone and tetrahydrofuran. The azeotropic mixture mentioned above is a mixture solution in which a composition of the liquid phase and a composition of the vapor phase are coincided with each other at a certain pressure to give a mixture having a constant boiling point. For example, a mixture consisting of 35 parts by weight of methanol and 65 parts by weight of 1,2-dichloroethane is an azeotropic solution, or a mixture consisting of 50 parts by weight of 1-butanol and 50 parts by weight of xylene.

The metal oxide particles can be tin oxide particles, titanium oxide particles, zinc oxide particles, aluminum oxide particles, and zirconium oxide particles. The average primary particle size of the metal oxide particles is suitably 500 nm or less; or in embodiments in the range of 20 nm to 200 nm, or in embodiments from 30 nm to 150 nm, or in embodiments from 30 nm to 100 nm.

In embodiments, the hygroscopic polymers are formed on the metal oxide particle surface through a phosphonatomethylaryl linkage from polymerization of hydrophilic monomers.

The phosphonatomethylaryl moieties disclosed herein bear functional groups from which hydrophilic polymer chains of specific sequence length can be polymerized or to which hydrophilic polymers can be grafted. The surface of the metal oxide particles is treated with a phosphonatomethylaryl moiety by mixing the metal oxide particles with the phosphonatomethylaryl moiety. The phosphonatomethylaryl moiety has a strong affinity to the metal oxide particle surface due to ionic interaction. This treatment produces phosphonatomethylaryl moieties attached to the metal oxide surface.

In embodiments, the phosphonatomethylaryl moiety has a vinyl group, an allyl group, an acryl group, or a methacryl group. The polymerization of the hydrophilic monomers with the phosphonatomethylaryl moiety can be initiated with a thermal initiator. In embodiments, the phosphonatomethylaryl moiety has a peroxide group or an azo group. The polymerization of the hydrophilic monomers with the phosphonatomethylaryl moiety having a peroxide group or azo group does not require a thermal initiator as the peroxide or azo functions as a thermal initiator.

The phosphonatomethylaryl moieties attached to the meal oxide particle surface are then polymerized. Free radical polymerization of a hydrophilic monomer with the phosphonatomethylaryl moiety produces a hygroscopic polymer attached to the surface of the metal oxide particles. The degree of polymerization of the attached hydrophilic polymer is from about 2 to about 2,000, or from about 20 to about 1,000, or from about 100 to about 500.

In embodiments, a phosphonatomethylaryl moiety having an vinyl group is shown below:

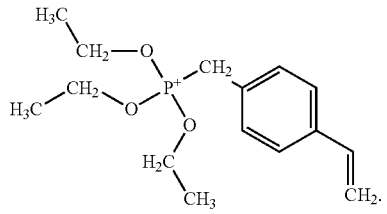

When a phosphonatomethylaryl moiety having an vinyl group, an allyl group, an acryl group, or a methacryl group is utilized to form a hygroscopic polymer on the surface of a metal oxide particle, a thermal initiator is utilized.

Common thermal initiators include peroxide compounds such as benzoyl peroxide, tert-amyl peroxybenzoate, 2,2-bis(tert-butylperoxy)butane, 1,1-bis(tert-butylperoxy)cyclohexane, 2,5-bis(tert-butylperoxy)-2,5-dimethylhexane, 2,5-bis(tert-butylperoxy)-2,5-dimethyl-3-hexyne, bis(1-(tert-butylperoxy)-1-methylethyl)benzene, 1,1-bis(tert-butylperoxy)-3,3,5-trimethylcyclohexane, tert-butyl hydroperoxide, tert-butyl peroxide, tert-butyl peroxybenzoate, tert-butylperoxy isopropyl carbonate, cumene hydroperoxide, cyclohexanone peroxide, dicumyl peroxide, lauroyl peroxide, and 2,4-pentanedione peroxide; azo compounds such as 2,2'-azobisisobutyronitrile, 4,4-azobis(4-cyanovaleric acid), and 1,1'-Azobis(cyclohexanecarbonitrile); and other compounds such as tert-butyl peracetate, peracetic acid, and potassium persulfate; and the like and mixtures thereof.

In embodiments, a phosphonatomethylaryl moiety having a peroxide group is shown below:

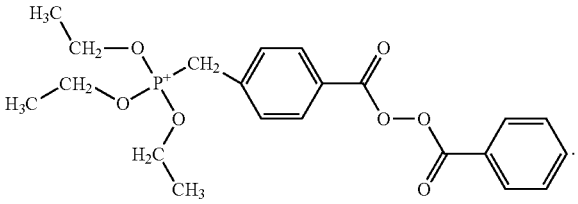

When a phosphonatomethylaryl moiety having a peroxide group or azo group is utilized, the peroxide group or azo group serve as a thermal initiator to polymerize hydrophilic monomers into hygroscopic polymers on metal oxide particle surface.

The hydrophilic monomers that can be used to form the hygroscopic polymer on the surface of the metal oxide polymer include; methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly(ethoxy (10) allyl ether), N,N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate, 4-vinylphenol and the like and mixtures thereof. The hydrophilic monomers are represented by, respectively:

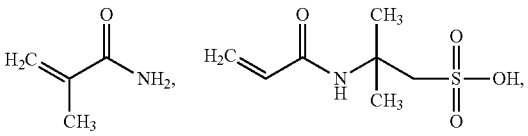

-continued

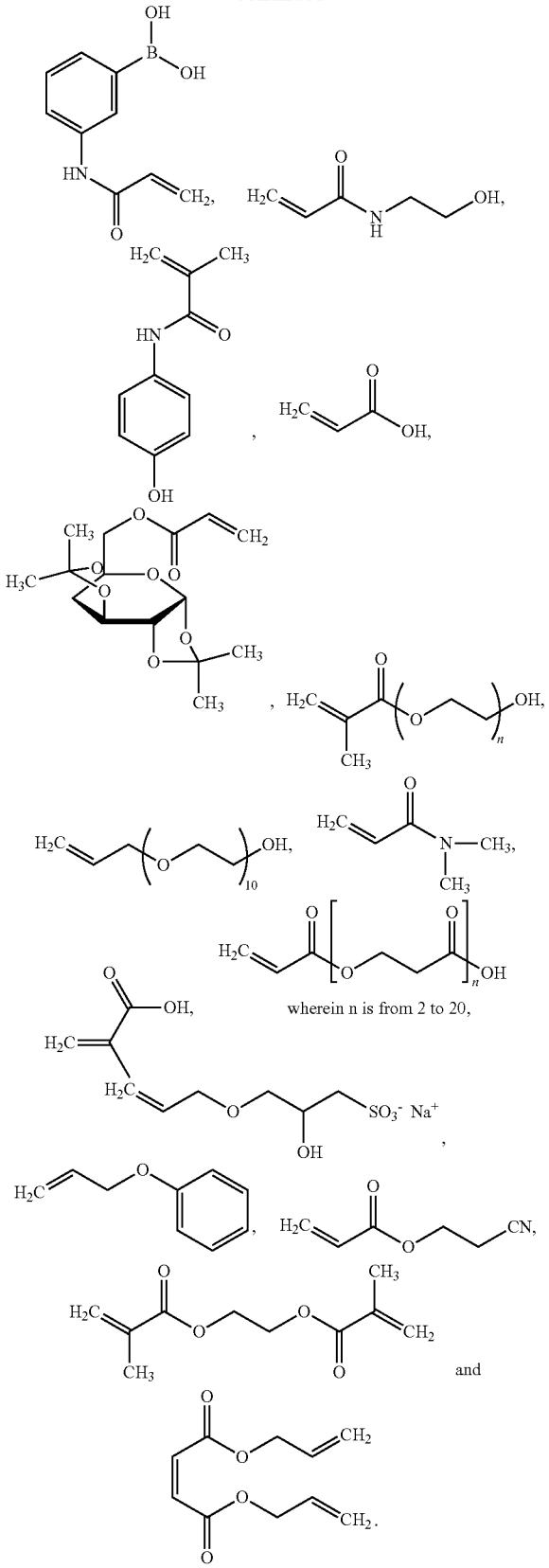

wherein n is from 2 to 20, and

Although not illustrated, optional layers may be provided in the photoreceptors shown in FIGS. 1-3. Example of optional layers include an intermediate layer, an adhesive layer or an anti-curl back coating layer.

Intermediate Layer

Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

The compounds used for forming the intermediate layer may be used alone or in the form of a mixture or polycondensate of multiple compounds. In particular, the intermediate layer is suitably a layer containing an organic metal compound that contains a zirconium atom or a silicon atom.

Adhesive Layer

An optional adhesive interface layer may be employed. An adhesive layer may be situated, for example, intermediate between the undercoat layer 11 and the charge generation layer 12. The adhesive layer may include a film-forming material, such as, a polyurethane, a polyester and so on. An example of a polyester includes a polyarylate, a polyvinylbutyral and the like.

Any suitable solvent or solvent mixture may be employed to form an adhesive layer coating solution. Typical solvents include tetrahydrofuran, toluene, monochlorobenzene, methylene chloride, cyclohexanone and the like, as well as mixtures thereof. Any suitable and conventional technique may be used to mix and thereafter to apply the adhesive interface layer coating mixture to the photoreceptor under construction as taught herein or as known in the art. Typical application techniques include spraying, dip coating, roll coating, wire wound rod coating and the like. Drying of the deposited wet coating may be accomplished by any suitable conventional process, such as oven drying, infrared drying, air drying and the like.

The adhesive layer may have a thickness of from about 0.01 μm to about 900 μm after drying. In certain embodiments, the dried thickness is from about 0.03 μm to about 1 μm.

Anti-Curl Back Coating Layer

An anti-curl back coating may be applied to the surface of a substrate opposite to that bearing the photoconductive layer(s) to provide flatness and/or abrasion resistance, such as, when a web configuration imaging device component is contemplated. The anti-curl back coating layer is known and can comprise a film-forming material or binder, such as, thermoplastic organic polymers or inorganic polymers. Such polymers are electrically insulating or slightly semi-conductive. The thickness of anti-curl back coating layers generally is sufficient to balance substantially the total forces of the layer or layers on the opposite side of a substrate. An example of an anti-curl back coating layer is described in U.S. Pat. No. 4,654,284, the disclosure of which is incorporated herein by reference in its entirety. A thickness of from about 70 μm to about 160 μm can be used for a flexible device imaging component, although the thickness can be outside that range as a design choice.

Because conventional anti-curl back coating formulations can suffer from electrostatic charge build up due to contact friction between the anti-curl back coating layer and, for example, backer bars, which can increase friction and wear, incorporation of compounds to dissipate charge, such as, nanopolymeric gel particles, into the anti-curl back coating layer can substantially eliminate charge build up. In addition to reducing electrostatic charge build up and reducing wear in the layer, a charge dissipating material, such as, nanopolymeric gel particles, may be used to enhance lubricity, scratch resistance and wear resistance of the anti-curl back coating layer. In some embodiments, the nanopolymeric gel particles are comprised of crosslinked polystyrene-n-butyl acrylate, which are dispersed or embedded in a film-forming material or binder, such as, a polymer or a matrix.

In some embodiments, the anti-curl back coating layer may comprise a charge transport molecule or component. The charge transport molecule may be present from about 1% to about 60% by weight of the total weight of the anti-curl back coating layer.

Various aspects of the embodiments of interest now will be exemplified in the following non-limiting examples. While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature(s) may be combined with one or more other features of the other implementations as may be desired and advantageous for any given or particular function.

EXAMPLES

Synthetic Example 1

Fifty grams of titanium dioxide ($TiO_2$) STR-60N (from Sakai Chemical Industry Co. Ltd.) are mixed with 200 grams of methyl isobutyl ketone with constant strong agitation. Five grams of a phosphonatomethylaryl moiety having the following structure are added and allowed to mix for 1 hour.

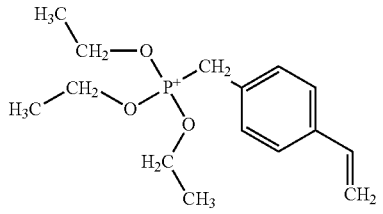

Ten grams of 4-vinylphenol and two grams of benzoyl peroxide are then added, and the mixture is heated up to about 80° C. The free radical polymerization is allowed to take place for 4 hours at this temperature with constant strong agitation. The treated $TiO_2$ is then separated from the rest of the mixture through filtration, and washed with THF three times. The resulting poly(4-vinyphenol) attached $TiO_2$ is dried at 80° C. under vacuum overnight.

Synthetic Example 2

Fifty grams of titanium dioxide ($TiO_2$) STR-60N (from Sakai Chemical Industry Co. Ltd.) are mixed with 200 grams of methyl isobutyl ketone with constant strong agitation. Five grams of a phosphonatomethylaryl moiety having the following structure are added and allowed to mix for 1 hour.

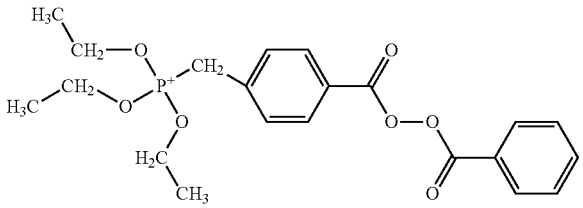

Ten grams of hydroxypoly(ethoxy (10) allyl ether) are then added, and the mixture is heated up to about 80° C. The free radical polymerization is allowed to take place for 4 hours at this temperature with constant strong agitation. The treated $TiO_2$ is then separated from the rest of the mixture through filtration, and washed with THF three times. The resulting poly[hydroxypoly(ethoxy (10) allyl ether)] attached $TiO_2$ is dried at 80° C. under vacuum overnight.

Example 1

The imaging member is fabricated comprising a 30 mm diameter mirror aluminum substrate, an undercoating layer having $TiO_2$ of Synthetic Example 1, a charge generating layer, and a charge transport layer.

The undercoat layer is fabricated from a coating dispersion consisting of $TiO_2$ of Synthetic Example 1 and phenolic resin (Varcum 29159, OxyChem) in xylene/1-butanol (wt/wt=50/50). The weight ratio of titanium dioxide and phenolic resin is 60/40. An aluminum drum substrate of 30 mm in diameter is coated with the undercoat layer coating dispersion and dried at a temperature of 145° C. for 45 minutes. The resulting undercoat layer has a thickness of about 4.0 micrometers.

The charge generating layer coating dispersion is prepared by dispersing 15 grams of hydroxygallium phthalocyanine (V) particles in a solution of 10 grams of VMCH, a terpolymer of vinyl alcohol, vinyl acetate and maleic acid from Dow Chemical, in 368 grams of n-butyl acetate. This dispersion is milled in an ATTRITOR with 1 mm glass beads for 3 hours. The drum with the undercoat layer then is coated with the charge generating layer coating dispersion. The resulting coated drum is air dried to form a 0.2-0.5-micrometer thick charge generating layer.

A charge transport layer is coated using a solution of a mixture of 60 weight % of PCZ400 (a polycarbonate Z, available from Mitsubishi Gas Chemical Company, Inc.), and 40 weight % of charge transport molecule N,N'-diphenyl-N,N'-bis(3-methylphenyl)-[1,1'-biphenyl]-4,4'-diamine. The solution is in 70:30 by weight ratio of tetrahydrofuran: toluene solvent mixture, providing an approximate solids content of 23 33% by weight. The charge transport layer is dried at 120° C. for 40 minutes. The dried charge transporting layer thickness is about 24 microns.

Example 2

The Example 2 imaging member is fabricated similarly to the Example 1 imaging member except that $TiO_2$ of Synthetic Example 1 is replaced with $TiO_2$ of Synthetic Example 2.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A photoreceptor comprising:

a conductive substrate;

an undercoat layer disposed on the conductive substrate, the undercoat layer including metal oxide particles having hygroscopic polymers attached to a surface of the metal oxide particles, wherein the hygroscopic polymers comprise phosphonatomethylaryl having a hydrophilic polymer attached thereto, wherein the hydrophilic monomers are selected from the group consisting of: methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly(ethoxy (10) allyl ether), N,N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof, and a binder resin selected from the group consisting of: a polyamide resin, a nylon resin and a phenolic resin; and a photosensitive layer disposed on the undercoat layer.

2. The photoreceptor according to claim 1, wherein the metal oxide particles are selected from the group consisting of: tin oxide particles, titanium oxide particles, zinc oxide particles, aluminum oxide particles, and zirconium oxide particles.

3. The photoreceptor according to claim 1, wherein the hygroscopic polymers are attached on the surface of the metal oxide particles through the phosphonatomethylaryl linkage from polymerization of the hydrophilic monomers.

4. The photoreceptor according to claim 1, further comprising an overcoat layer disposed on the photosensitive layer.

5. The photoreceptor according to claim 1, wherein the metal oxide particles having hygroscopic polymers attached to a surface of the metal oxide particles comprise from about 10 weight percent to about 80 weight percent relative to the weight of binder resin in the undercoat layer.

6. The photoreceptor according to claim 1, wherein the phosphonatomethylaryl comprises a moiety having a structure:

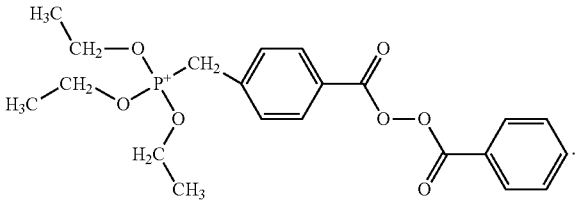

7. The photoreceptor according to claim 1, wherein the phosphonatomethylaryl comprises a moiety having a structure:

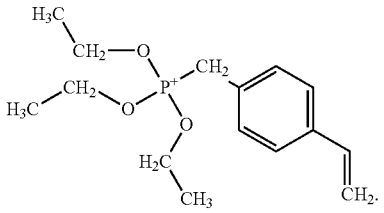

8. A photoreceptor comprising:

a conductive substrate;

an undercoat layer disposed on the conductive substrate, the undercoat layer including metal oxide particles having hygroscopic polymers attached to a surface of the metal oxide particles, wherein the hygroscopic polymers comprise phosphonatomethylaryl having a hydrophilic polymer attached thereto, wherein the hydrophilic monomers are selected from the group consisting of: methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1, 2:3,4-bis-O-(1-methylethylidene)-α-D-galactopyranose, poly(ethoxy (10) ethyl methacrylate), hydroxypoly(ethoxy (10) allyl ether), N,N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof and a binder resin selected from the group consisting of: a polyamide resin, a nylon resin and a phenolic resin;

a charge generation layer disposed on the undercoat layer; and a charge transport layer disposed on the undercoat layer.

9. The photoreceptor according to claim 8, wherein the metal oxide particles are selected from the group consisting of: tin oxide particles, titanium oxide particles, zinc oxide particles, aluminum oxide particles, and zirconium oxide particles.

10. The photoreceptor according to claim 8, wherein the hygroscopic polymer is formed on the metal oxide surface through the phosphonatomethylaryl linkage from polymerization of the hydrophilic monomers.

11. The photoreceptor according to claim 8, further comprising an overcoat layer disposed on the photosensitive layer.

12. The photoreceptor according to claim 8, wherein the metal oxide particles having hygroscopic polymers attached to a surface of the metal oxide particles comprise from about 10 weight percent to about 80 weight percent relative to the weight of binder resin in the undercoat layer.

13. A method of modifying a surface of a metal oxide particle comprising;

mixing the metal oxide particle with a phosphonatomethylaryl moiety wherein the phosphonatomethylaryl moiety attaches to the surface; and polymerizing a hydrophilic monomer with the phosphonatomethylaryl moiety to form a hygroscopic polymer on the surface of the metal oxide particle, wherein the hydrophilic monomers are selected from the group consisting of: methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1, 2:3,4-bis-O-(1-methylethylidene)-α-D-galactopyranose, poly(ethoxy (10) ethyl methacrylate), hydroxypoly(ethoxy (10) allyl ether), N,N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof.

14. The method according to claim 13, wherein the phosphonatomethylaryl moiety has a vinyl group, an allyl group, an acryl group, or a methacryl group.

15. The method according to claim 14, wherein the polymerization of the hydrophilic monomer with the phosphonatomethylaryl moiety is initiated with a thermal initiator.

16. The method according to claim 13, wherein the phosphonatomethylaryl moiety comprises the structure:

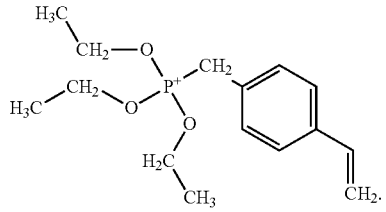

17. The method according to claim 13, wherein the phosphonatomethylaryl moiety has a peroxide group or an azo group.

18. The method according to claim 17, wherein the phosphonatomethylaryl moiety comprises the structure:

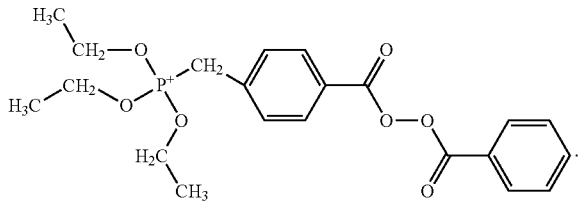

19. The method according to claim 13, wherein a degree of polymerization of the attached hygroscopic polymer is from about 2 to about 2,000.

* * * * *